US006623340B2

(12) United States Patent
Jansson

(10) Patent No.: US 6,623,340 B2
(45) Date of Patent: Sep. 23, 2003

(54) GRINDING JIG

(75) Inventor: Torgny Jansson, Lindesberg (SE)

(73) Assignee: Tormek AB, Lindesberg (SE)

( * ) Notice: Subject to any disclaimer, the term of this patent is extended or adjusted under 35 U.S.C. 154(b) by 0 days.

(21) Appl. No.: 10/156,096

(22) Filed: May 29, 2002

(65) Prior Publication Data

US 2002/0197942 A1 Dec. 26, 2002

(30) Foreign Application Priority Data

May 30, 2001 (SE) ..... 0101884-5

(51) Int. Cl.[7] ..... B24B 3/55

(52) U.S. Cl. ..... 451/241; 451/248; 451/185; 451/192; 451/212

(58) Field of Search ..... 451/420, 241, 451/555, 248, 185, 192, 193, 212, 234; 269/249, 43, 95

(56) References Cited

U.S. PATENT DOCUMENTS

| | | | | | |
|---|---|---|---|---|---|
| 2,128,591 | A | * | 8/1938 | McGill | 451/321 |
| 2,911,771 | A | * | 11/1959 | Amiet | 451/375 |
| 4,936,053 | A | * | 6/1990 | Shanelec | 451/224 |
| 5,218,787 | A | * | 6/1993 | Rice | 451/229 |
| 5,331,774 | A | * | 7/1994 | Domenella | 451/45 |
| 5,810,649 | A | * | 9/1998 | Oar et al. | 451/378 |

* cited by examiner

*Primary Examiner*—George Nguyen
(74) *Attorney, Agent, or Firm*—Breiner & Breiner, L.L.C.

(57) ABSTRACT

A grinding jig (5) is to be attached on an edge tool (4) to be ground on a rotating grindstone (2) in a grinding machine (1), having a support means (3) in the vicinity of the grindstone. The jig is split by having a base portion (6) and two parallel open yokes (8, 9) extending therefrom. A screw (7) for clamping the tool (4) against the bottoms of the yokes is provided in the base portion between the two yokes.

5 Claims, 2 Drawing Sheets

GRINDING JIG

TECHNICAL FIELD

The present invention relates to a grinding jig for attachment on an edge tool to be ground on a rotating grindstone in a grinding machine, having a support means in the vicinity of the grindstone.

BACKGROUND OF THE INVENTION

Such a grinding jig is used for holding the tool at a constant angle towards the grindstone, so that the tool edge gets a single bevel without any extra and non-desired bevels, but also for holding it steadily sideways for obtaining a clean and sharp edge.

A conventional grinding jig may be an open yoke with a certain width. The tool is to be inserted in the yoke and is clamped therein by a screw. At grinding, the rear side of the yoke or the side of the yoke facing from the grindstone and the tool shank is applied against the support means, usually in the form of a cylindrical support bar.

The opening in a jig suitable for grinding curved gouges may preferably have a triangular shape, so that the tool shank is clamped by the screw against the V-shaped bottom of the jig.

By the geometry at grinding, the tool shank needs to have a certain minimum length, in practice say 75 mm at an edge angle of 20°. Many woodcarving tools, especially palm-held tools, have a shorter length and accordingly cannot be ground with this jig.

This jig gives the tool a fixed angle. However, the direction of the tool has to be controlled by keeping the jig at all times in contact with the support bar during the grinding operation. Experience and a certain skill are required from the operator, whose attention has to be directed to this.

Further, the pressure from the screw is distributed over the entire bottom surface of the jig via the tool shank. If the shank surface is not straight, but convex, the shank rides in the middle of the jig under the screw, which means that the clamping is not stable.

THE INVENTION

The above drawbacks are according to the invention eliminated in that the jig is split by having a base portion and two parallel open yokes extending therefrom, the screw for clamping the tool against the bottoms of the yokes being provided in the base portion between the two yokes.

Hereby the grinding jig will provide guidance on both sides of the support bar, as the jig at grinding is placed astraddle of the support bar with the two yokes at either side of the bar.

The following advantages are obtained:

Tools with a shank length down to only 45 mm at a 20° edge angle can be ground, i e practically all woodcarving tools.

The jig automatically controls that the tool is perpendicular to the grindstone. The attention of the operator can be concentrated on the tool edge engagement with the grindstone and not to keeping the tool perpendicular to the grindstone.

The jig locks the tool in both axial directions in relation to the support bar.

The tool is firmly clamped in the jig by the fact that it is supported by the preferably V-shaped bottoms of the two yokes.

THE DRAWINGS

Figure 1:
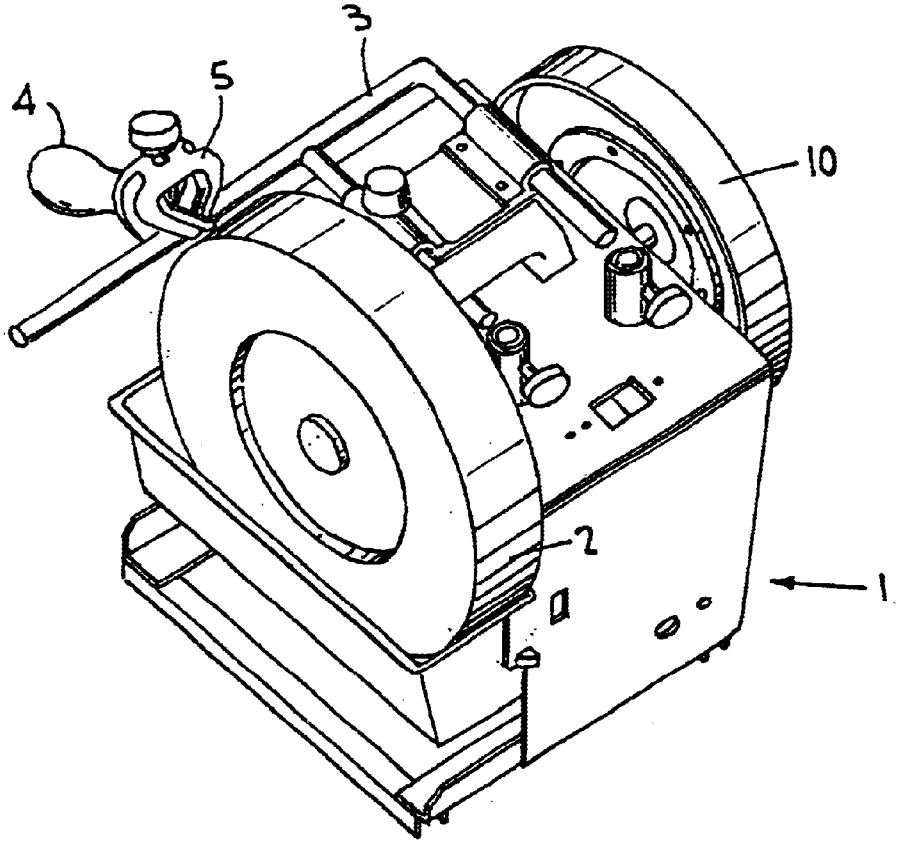
Figure 2:
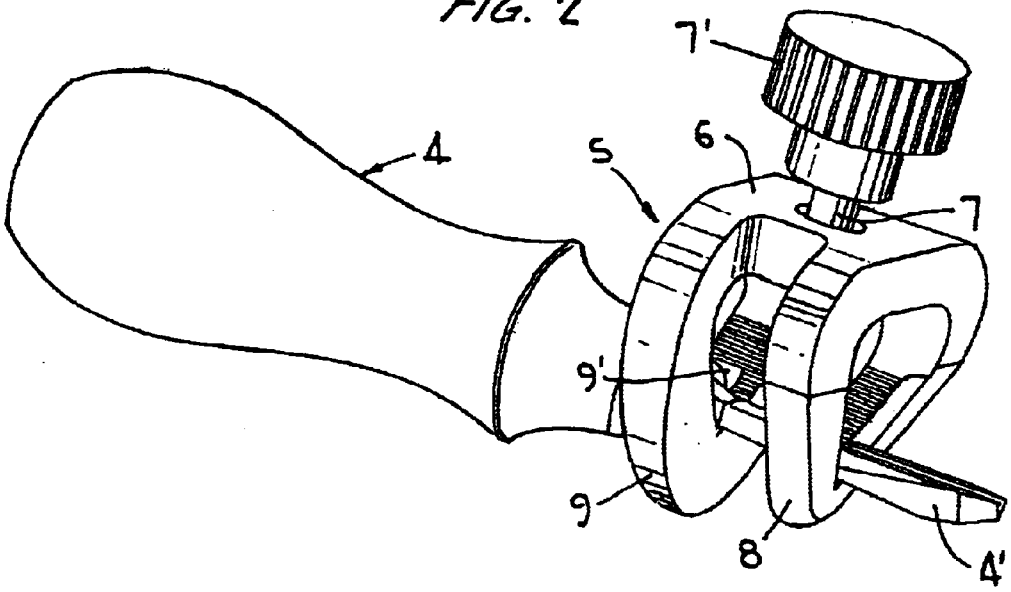
Figure 3:
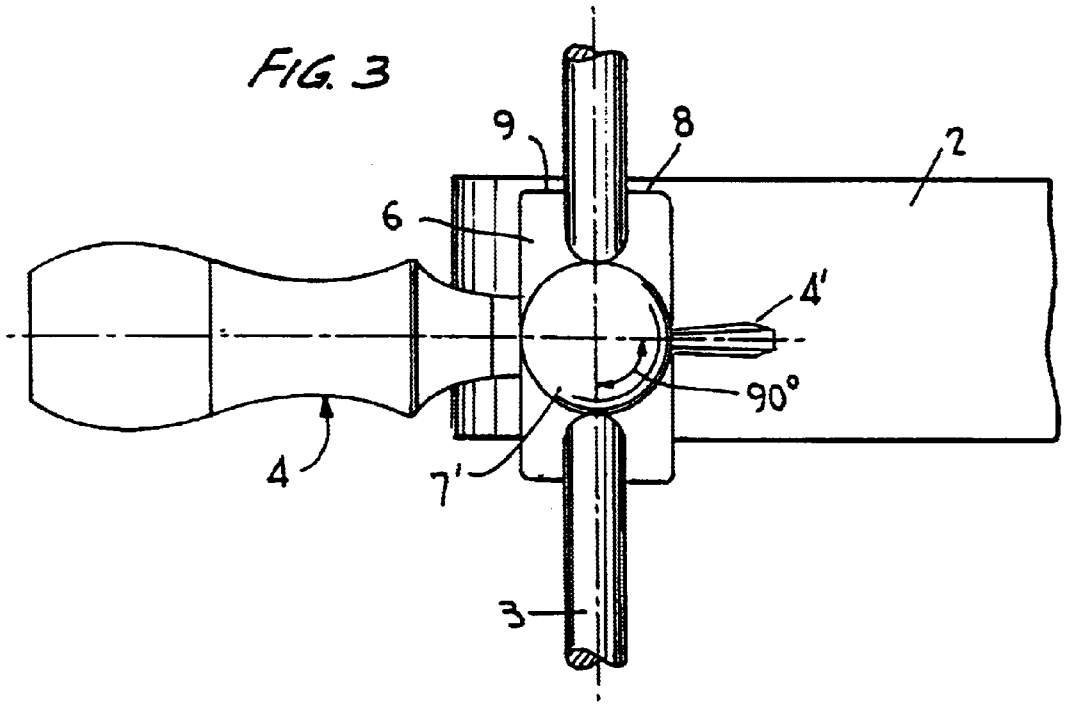
Figure 4:
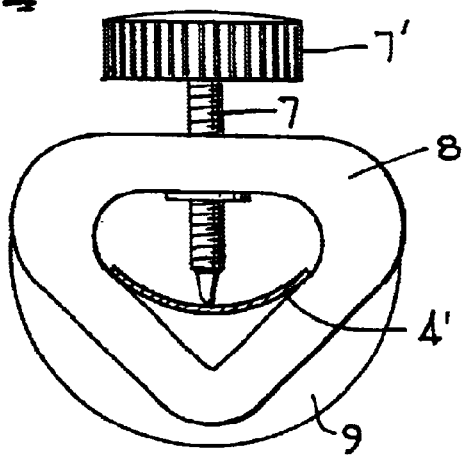

The invention will be described in further detail below under reference to the accompanying drawings, in which FIG. 1 is a perspective view of a grinding machine and illustrates the use of a grinding jig according to the invention, FIG. 2 is a perspective view to a larger scale of the grinding jig according to the invention attached to a so called V-tool to be ground, FIG. 3 is a top view of the grinding jig attached to the tool and of a support bar of the grinding machine, and FIG. 4 is an end view to the left in FIG. 2 of the grinding jig with an alternative tool, namely a wide gouge.

DETAILED DESCRIPTION OF A PREFERRED EMBODIMENT

A conventional grinding machine 1 is shown in FIG. 1. The machine is provided with a grindstone 2 driven by an electric motor in the machine. In the present case the grindstone 2 is driven at a comparatively low speed, but it may alternatively be driven at a high speed. The machine 1 is provided with a cylindrical support bar 3. The purpose of the support bar 3 is—as indicated in FIG. 1—to serve as a guiding means for an edge tool 4 to be sharpened by the grindstone 2.

For the general purpose of assisting the operator to hold the tool 4 correctly in relation to the grindstone 2 and on the support bar 3, a grinding jig 5 may be used.

When grinding an edge tool 4 on the grindstone 2 it is important that the tool is held at a constant angle against the grindstone, so that the tool edge gets a single bevel only and not any extra or unwanted bevels. The tool also has to be held steadily sideways, so that a clean and sharp edge is obtained.

A grinding jig accordingly has the purpose of assisting the operator to obtain this desired end result.

A conventional grinding jig for this purpose consists of an open yoke with a certain width (in the axial direction of the tool). The tool is inserted into the jig and clamped therein by a screw. At grinding, the tool with the jig is held by the operator against the support bar.

A grinding jig 5 according to the invention is best shown in FIG. 2. It has a base portion 6 with a central threaded bore, with which a screw 7 having a screw head 7' engages. Two open yokes 8 and 9 are integral with the base portion 6. The openings in the yokes 8 and 9 preferably have a triangular shape as shown, which means that the yokes have V-shaped bottoms. The shank 4' of the tool 4 to be ground is inserted in the yokes 8, 9 and clamped against the V-shaped bottoms by means of the screw 7. The distance between the yokes 8 and 9 corresponds to the diameter of the support bar 3, which clearly appears in FIG. 3. The yoke 8 to be facing the grindstone 2 preferably has a smaller thickness than the other yoke 9 for enabling grinding of a shortest possible tool shank 4'. Also, the yoke 9 may have a lower bevel or notch 9' for allowing the tool handle to extend into this yoke. In practice, the tool shank 4' may be as short as 45 mm at an edge angle of 20°.

The grinding jig according to the invention provides a number of advantages in relation to a conventional jig, mainly by being split or having two yokes as shown and described.

Tools with a shaft length down to only about 45 mm at an edge angle of 20° can be ground, so that practically all woodcarving tools may be ground. With a conventional jig the minimum length may be about 75 mm, which means that many tools cannot be ground with such a jig.

By the fact that the support bar 3 at operation is placed between the two yokes 8 and 9, the jig automatically controls that the tool 4 is always perpendicular (90°) to the grindstone 2. The attention of the operator can be concentrated on where the edge touches the grindstone not its direction.

The jig 5 locks the tool 4 both in the direction towards the stone and in the direction away from the stone.

A firm clamping of the tool 4 in the jig 5 is always obtained due to the fact that the tool is pressed against the two yokes, not in the middle of the single yoke of the conventional jig.

The grinding jig according to the invention may also be used for honing. With a reversed support bar 3 in FIG. 1 the right wheel 10 can be used for honing.

What is claimed is:

1. A grinding jig (5) for attachment on an edge tool (4) to be ground on a rotating grindstone (2) in a grinding machine (1), having a support means (3) in the vicinity of the grindstone, characterized in that the jig (5) is split by having a base portion (6) and two parallel open yokes (8, 9) extending therefrom, a screw (7) for clamping the tool (4) against the bottoms of the yokes being provided in the base portion between the two yokes.

2. A jig according to claim 1, characterized in that distance between the two yokes (8, 9) corresponds to the diameter of said support means (3) attached to the grinding machine (1).

3. A jig according to claim 1, characterized in that the yokes (8, 9) have V-shaped bottoms, against which the tool (4) is to be clamped.

4. A jig according to claim 1, characterized in that the yoke (8) to be facing the grindstone (2) has a smaller material thickness than the other yoke (9).

5. A jig according to claim 1, characterized in that the yoke (9) to be facing the handle of the tool (4) is provided with a lower bevel or notch (9') for the handle.

* * * * *